US006565021B2

(12) United States Patent
Börner et al.

(10) Patent No.: US 6,565,021 B2
(45) Date of Patent: May 20, 2003

(54) HIGH SPEED ROTARY ATOMIZER WITH DIRECTING AIR RING

(75) Inventors: Gunter Börner, Mühlhausen (DE); Steffen Georgi, Strassberg (DE); Josef Wittmann, Hockenheim (DE); Hidetoshi Yamabe, Tokyo (JP)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/953,726

(22) Filed: Sep. 17, 2001

(65) Prior Publication Data

US 2002/0066809 A1 Jun. 6, 2002

Related U.S. Application Data

(63) Continuation of application No. PCT/EP99/01705, filed on Mar. 16, 1999.

(51) Int. Cl.[7] ..... B05B 5/08

(52) U.S. Cl. ..... 239/703

(58) Field of Search ..... 239/703, 706, 239/708

(56) References Cited

U.S. PATENT DOCUMENTS 4,887,770 A * 12/1989 Wacker et al. ..... 239/110
5,775,598 A * 7/1998 Takayama et al. ..... 239/703

* cited by examiner

*Primary Examiner*—Lisa A. Douglas
(74) *Attorney, Agent, or Firm*—Laurence A. Greenberg; Werner H. Stemer; Ralph E. Locher

(57) ABSTRACT

A rotary atomizer with external charging which can be used for applying conductive paints, in particular water-based paint, to a surface of a body to be coated. The rotary atomizer has a directing air ring at a high-voltage potential and an earthed spraying bell. To reduce the risk of discharges, it is proposed to connect the ring to an earth potential via a high-impedance resistance, so that the ring assumes a potential which lies between the high-voltage potential of electrodes for the external charging and the earth potential of the bell.

11 Claims, 6 Drawing Sheets

HIGH SPEED ROTARY ATOMIZER WITH DIRECTING AIR RING

This application is a continuation of copending International Application No. PCT/EP99/01705, filed Mar. 16, 1999, which designated the United States and which was published on Sep. 21, 2000 in a language other than English.

BACKGROUND OF THE INVENTION

Field of the Invention

The invention relates to a rotary atomizer with external charging, which can be used for applying conductive paints, in particular water-based paint, to a surface of a body to be coated. Rotary atomizers are described, for example, in German Patents DE 31 30 096 C2 and DE 31 51 929 C2 and in European Patent Application EP 0 829 306 A2.

The water-based paint is in these cases fed centrally to a bell that rotates at high speed (10,000 rpm to 70,000 rpm). The centrifugal force causes the paint to be taken to the edge of the bell and thrown out from there in the form of small drops. Consequently, in the first moment of flight, the droplets move parallel to the surface of the object to be coated, which is located in front of the atomizer. An air stream from the atomizer in the direction of the object to be coated then has the effect of directing the droplets in the direction of the object to be coated. The air is discharged from the atomizer behind the bell out of bores or slits. To achieve a high application efficiency, the droplets are electrostatically charged. This takes place by needle electrodes, which are provided radially around the bell and are at a negative d.c. voltage potential. The voltage lies in the range between −40 kV and −100 kV. The high field strengths occurring in this case in front of the needle tips (>25 kV/cm) lead to an ionizing of the air in front of the needle tips. The electrons produced as a result are deposited on air molecules and form negative ions, which move in the electric field to the bell, which is at an earth potential, and to the earthed object to be coated. On their way there, they cross the droplets and negatively charge them. A force in the direction of the object to be coated, which is induced by the interaction of the electric charge with the electric field, acts on the charged droplets. This force, and consequently the application efficiency, is in this case all the greater the greater the field strength and the charge. There is an upper limit for the applied voltage. As from a given voltage level, the uniform corona discharges change into so-called streamers. These on the one hand lead to a very uneven charging of the droplets and on the other hand can initiate the breakdown between the needle electrodes and the earthed bell.

A further problem is that turbulence at the edge of the bell causes the droplets to be directed in the direction of the atomizer body. It is therefore proposed in U.S. Pat. No. 5,775,598 to produce the directing air ring from a conductive material and connect it to the earth potential. Consequently, a space-charge cloud is produced between the atomizer body and the cloud of droplets sprayed out from the edge of the bell by the current flow of the ions from the needle tips to the earthed directing air ring. The repelling forces of the negatively charged droplets and the negative ions are intended to avoid soiling of the atomizer body. This configuration also has the advantage that the directing air openings can be made in a metallic part. This ensures greater uniformity of the directing air in comparison with plastic parts, since the production tolerances are greater in the case of plastic parts than in the case of metal parts. Furthermore, the sometimes observed discharges from the turbine through the directing air openings, which may lead to destruction of the latter, can be avoided.

However, the configuration has decisive disadvantages. The distance of the edge of the directing air ring from the needle tips is generally smaller than the distance of the edge of the bell from the needle tips. As a result, only a small part of the negative electrons generated at the needle tip is directed to the edge of the bell and the field strength in the region of the edge of the bell is low. Consequently, the charging of the droplets is not sufficient for high efficiency.

The edge of the directing air ring is connected to the plastic surface of the atomizer body. This produces boundary surfaces at which comparatively high-current discharges (streamers) occur, leading to the destruction of the plastic surface.

SUMMARY OF THE INVENTION

It is accordingly an object of the invention to provide a high speed rotary atomizer with a directing air ring which overcomes the above-mentioned disadvantages of the prior art devices of this general type, with which an increased efficiency is achieved along with a reduced tendency for discharges to occur.

With the foregoing and other objects in view there is provided, in accordance with the invention, a high-speed rotary atomizer for applying electrically conductive paint, including water based paints. The high-speed rotary atomizer includes an electrode configuration having electrodes for electrostatic external charging, an atomizer housing formed of an electrically insulating material, driving devices disposed in the atomizer housing, and an electrically conductive spraying bell to be connected to an earth potential. The spraying bell is able to be set in rotation by the driving devices. A directing air ring formed of an electrically conductive material which operationally carries a high-voltage potential and is capable of blowing out directing air, is provided. A device is provided which forms an ohmic resistance in a range from 10 MΩ to 500 MΩ and establishes an electrical connection of the directing air ring to the earth potential through the ohmic resistance.

The measures according to the invention succeed in setting the directing air ring to a potential that lies between the earth potential (bell and turbine) and the high voltage potential of the needle tips. For this purpose, the directing air ring is not directly earthed (grounded) but is connected to the earth potential via an ohmic resistance.

In accordance with an added feature of the invention, the device includes at least one resistance component disposed for connecting the directing air ring to the earth potential.

In accordance with an additional feature of the invention, at least one spring element is disposed between the resistance component and the directing air ring for providing an electrical contacting of the resistance component.

In accordance with another feature of the invention, the directing air ring is formed from a high-impedance material, so that the directing air ring itself is used as the device for connecting to the earth potential. The directing air ring has an ohmic resistance in a range from 10 MΩ to 500 MΩ between an edge of the directing air ring facing the electrodes and a component carrying the earth potential.

In accordance with a further feature of the invention, an electrically insulating part covers the directing air ring in a region facing the spraying bell, whereby a minimum distance of 4 mm to 15 mm is set between an uncovered region of the directing air ring and the spraying bell.

In accordance with a further added feature of the invention, an electrically insulating part covers the spraying bell on its outer side, facing the directing air ring.

In accordance with a further additional feature of the invention, an insulating-material ring is provided and a part of the directing air ring facing the electrodes is covered by the insulating-material ring. A ring formed of a high-impedance material is inserted between the insulating-material ring and the directing air ring to reduce a field strength. Air gaps between the ring, the insulating-material ring and the directing air ring being avoided by suitable shaping of the ring, the insulating-material ring and the directing air ring.

In accordance with another further feature of the invention, an insulating part covers a partial region of a surface of the directing air ring. The insulating part covers an edge of the directing air ring facing the spraying bell to reduce a risk of electrical breakdowns between the directing air ring and the spraying bell.

In accordance with an added feature of the invention, the insulating part has openings formed therein such that additional air can be blown through the openings in the insulating part into an intermediate space between the insulating part and the spraying bell, whereby air vortices at an edge of the spraying bell can be avoided.

In accordance with a concomitant feature of the invention, a coating of a high-impedance material is provided, and the insulating-material ring has a front edge covered by the coating to reduce a field strength in a region of the front edge of the insulating-material ring. In particular, the coating is a paint coating.

Other features which are considered as characteristic for the invention are set forth in the appended claims.

Although the invention is illustrated and described herein as embodied in a high speed rotary atomizer with a directing air ring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
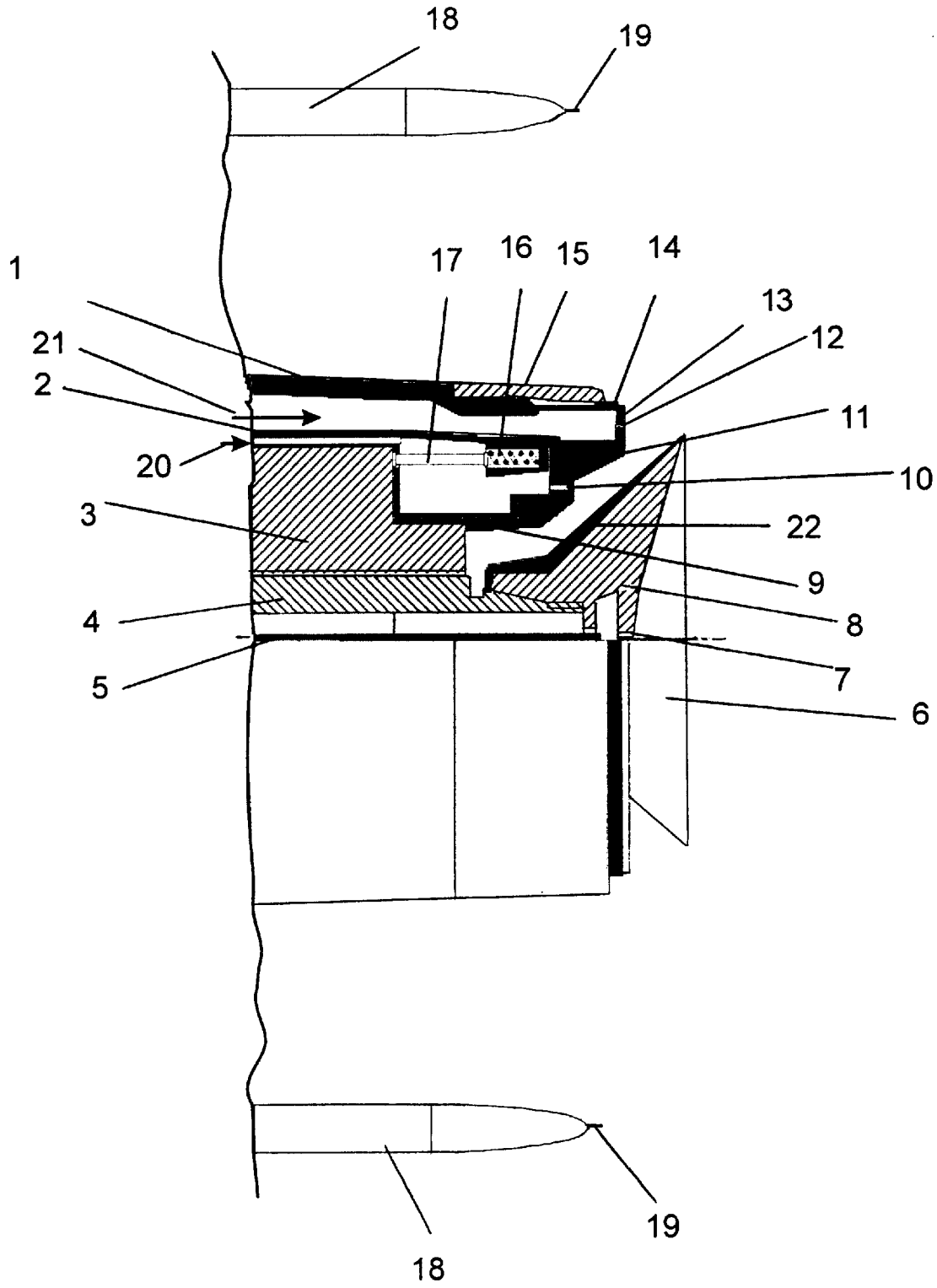
FIG. 1 is a diagrammatic, partial, sectional view of an atomizer with a directing air ring, spraying bell and at least one resistance component for a high-impedance connection of the directing air ring to an earth potential according to the invention.

In all the figures of the drawing, sub-features and integral parts that correspond to one another bear the same reference symbol in each case. Referring now to the figures of the drawing in detail and first, particularly, to FIG. 1 thereof, there is shown a detail of an atomizer with a turbine 3, which is produced from a conductive material (metal and carbon). The turbine 3 is directly earthed (grounded). The turbine 3 is generally provided with an air mounting. However, rolling contact bearings are also possible. A shaft 4 of the turbine 3 is a hollow shaft, in which a conductive-paint supply line 5, a non-illustrated solvent supply line, and a paint return line are located. Provided on an end face of the shaft 4 is a bell 6, which is generally produced from metal. The paint fed in the paint supply lines 5 leaves through openings 7 and 8 and runs on an end face of the bell 6 to an edge of the bell 6, from which the paint is sprayed off. The turbine 4 is surrounded by a housing 1 formed of a non-conductive material (generally plastic). Air 20, 21 is taken to the front of the atomizer by corresponding components 2, 9, 11 formed of an insulating material. A directing air ring 13, produced from a conductive material, has openings 12 for the directing air 21. The directing air ring 13 is electrically connected to the turbine 3 via one or more parallel resistors 17 (resistance components). Good contacting can be achieved for example by springs 16.

Since the directing air ring 13 is at a different potential (for example −10 kV) than the earthed bell 6 during operation, it must be ensured that no breakdowns occur between the directing air ring 13 and the bell 6. In the exemplary embodiment represented in FIG. 1, the conductive directing air ring 13 is provided towards the bell with the insulating part 11, which in particular covers an edge of the directing air ring 13. More specifically, the insulating part 11 covers the directing air ring 13 in a region facing the spaying bell 6, whereby a minimum distance of 4 mm to 15 mm is set between an uncovered region of the directing air ring 13 and the spraying bell 6. Furthermore, the additional air 20, which avoids air vortices at the edge of the bell 6, is passed through openings 10 in this insulating part 11.

Figure 2:
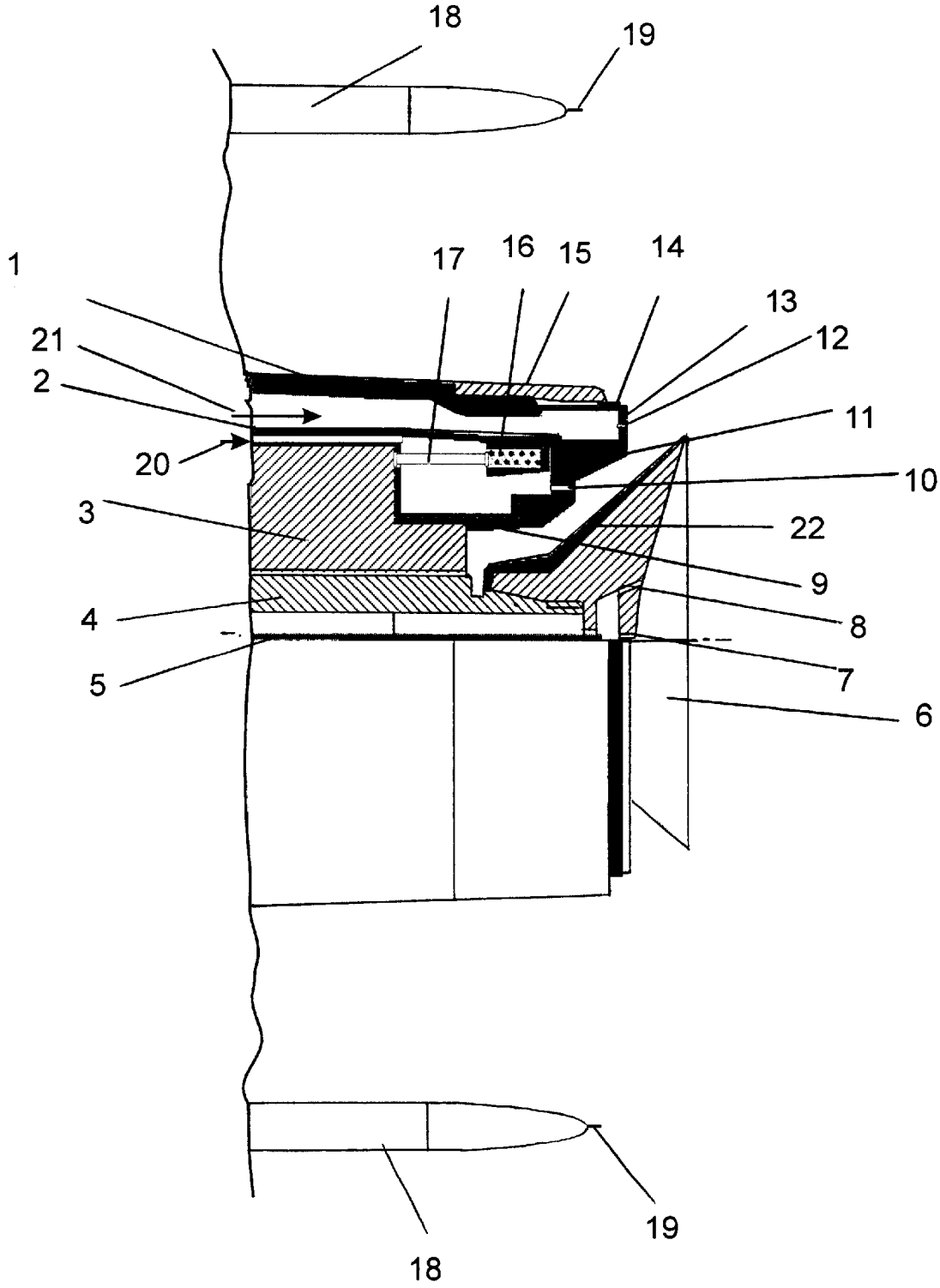
FIG. 2 is a partial, sectional view of the atomizer according to FIG. 1 with an additional insulating part on the bell.

In the exemplary embodiment represented in FIG. 2, the bell 6 is additionally covered on an outer side by an insulating part 22, to increase further the immunity to breakdowns.

Figure 3:
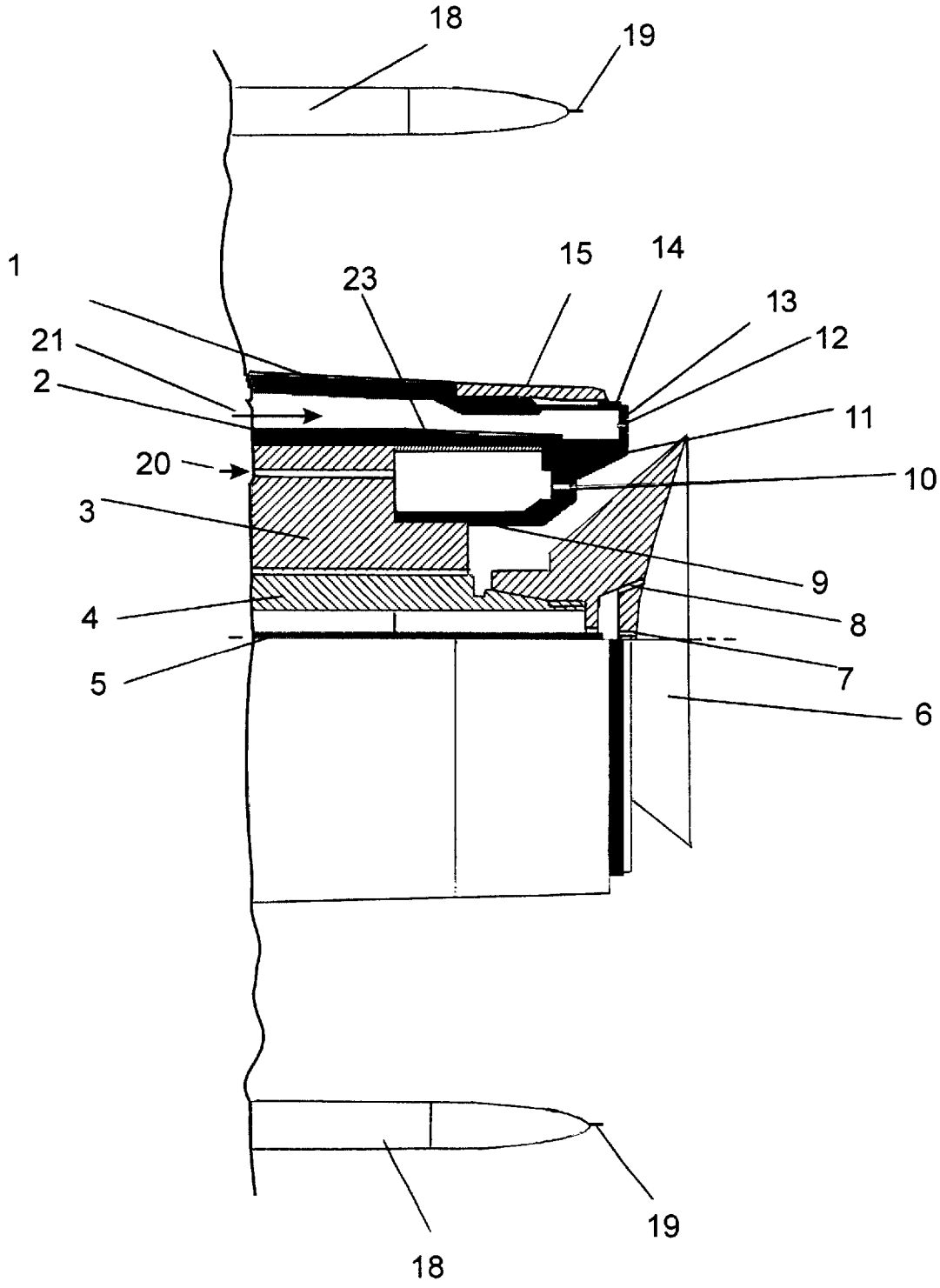
FIG. 3 is a partial, sectional view of the atomizer according to FIG. 1 with an alternative configuration of the high-impedance connection.

The connection between the directing air ring 13 and the earthed turbine 3 may also take place via resistance components 23 which are produced from a material which correspondingly has the same electrical resistance as the resistors 17 presented above. This is represented as an exemplary embodiment in FIG. 3.

A further possibility, not represented in the drawing, is to produce the directing air ring 13 itself from a high-impedance material and connect it to earth. In this case, the resistance between the edge of the directing air ring 13 which is facing the needle electrodes and the earth potential should lie in the range from 10 MΩ to 500 MΩ.

Figure 4:
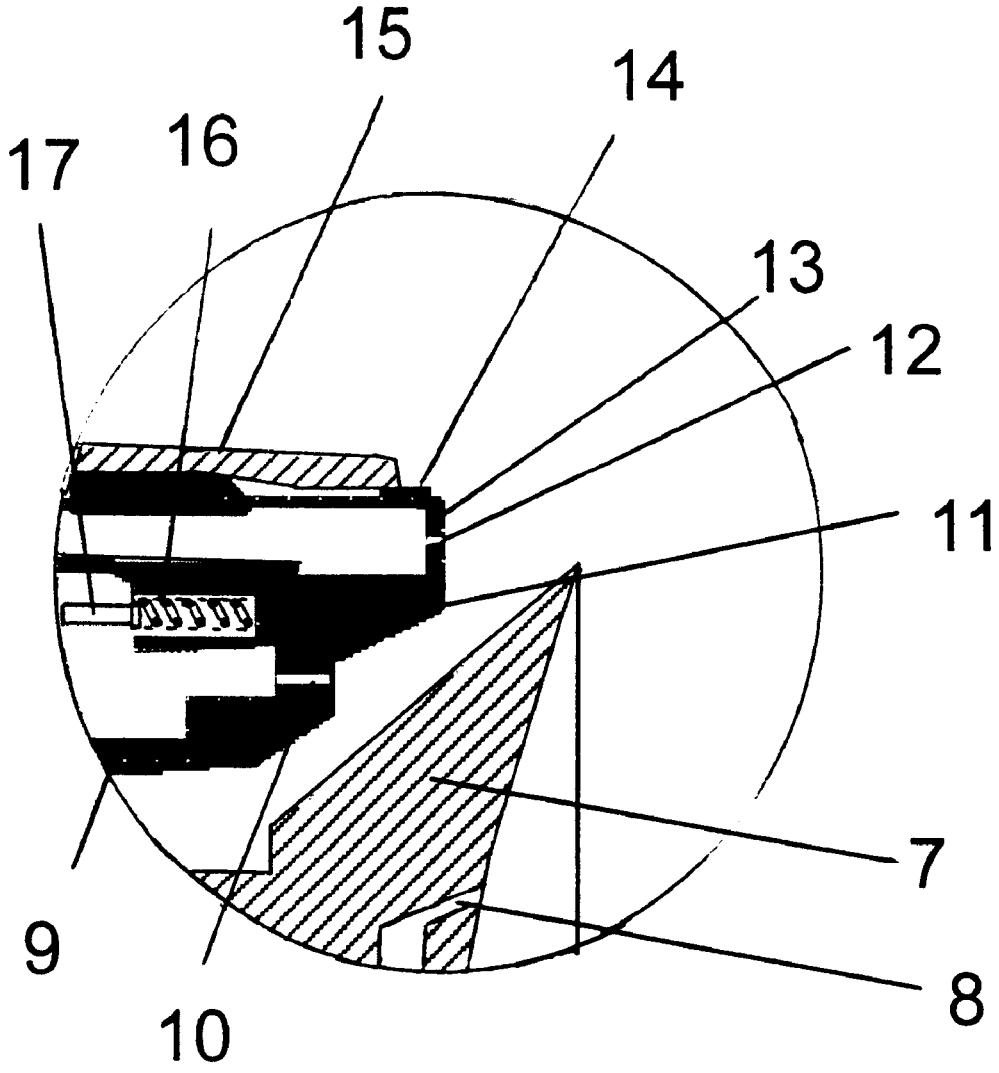
FIG. 4 is an enlarged, partial, sectional view of a representation of measures for reducing a field strength at edges of the directing air ring.
Figure 5:
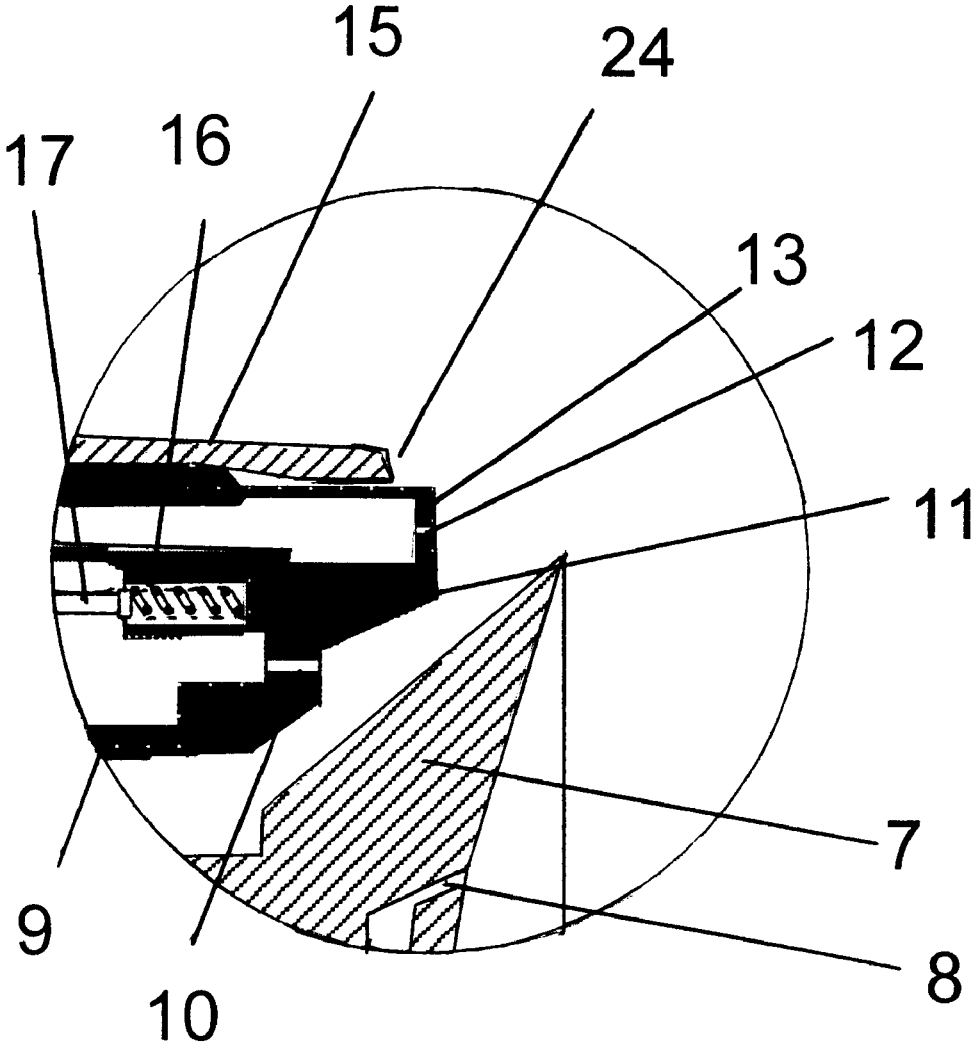
FIG. 5 is an enlarged, partial, sectional view for alternative measures for reducing the field strength.

For reliable operation, it is to be endeavored to avoid the occurrence of high field strengths, which lead to streamer discharges, at the edge of the directing air ring 13 facing an electrode holder 18 with needle electrodes 19. For this purpose, a high-impedance connection that reduces the potential may be introduced between the conductive directing air ring 13 and a plastic covering 15. A simple exemplary embodiment is represented in FIG. 4. A ring 14 formed of a high-impedance material (for example plastic with admixed graphite or carbon black) has been placed between the directing air ring 13 and the plastic covering 15. The ring 14 must be in definite contact with the plastic covering 15 around the entire circumference. Air gaps must in any event be avoided both between the high-impedance ring 14 and the insulating plastic covering 15 and between the high-impedance ring 14 and the directing air ring 13. A further possibility is for the front edge of the plastic covering 15 to be coated with a high-impedance material 24, for example paint, in the way represented in FIG. 5. In this case it must in turn be ensured that no air gaps occur. Combinations of the two measures represented in FIG. 4 and FIG. 5 are also possible.

Figure 6:
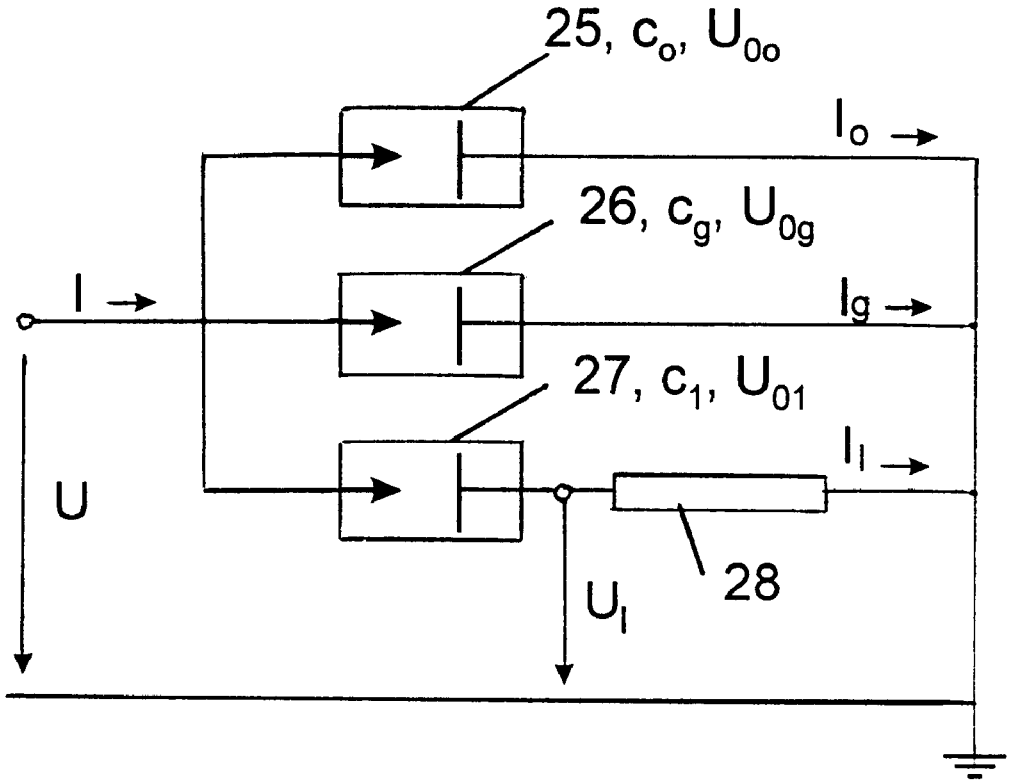
FIG. 6 is a block diagram of a simplified equivalent electrical circuit diagram.

The greatly simplified equivalent electrical circuit diagram is represented in FIG. 6. The electric circuit includes gas discharge paths between the needle tips and an earthed object 25 to be coated, between the needle tips and an earthed bell 26, between the needle electrodes and a directing air ring 27, and a resistor 28 between the directing air ring and earth. The current-voltage characteristics of the gas discharge paths can be approximated by the following equations:

a) between the needle tips and the earthed object to be coated $I_o=c_o\ (U-U_{0o})^2$;

b) between the needle tips and the earthed bell $I_g=c_g\ (U-U_{0g})^2$; and c) between the needle electrodes and the directing air ring $I_l=c_l\ (U-U_l-U_{0l})^2$.

The voltage $U_l$ at the directing air ring results from the current $I_l$ to the directing air ring and the electrical resistance $R_l$ between the directing air ring and earth $$U_l=I_lR_l.$$

The overall current of the atomizer is the sum of the three partial currents to the earthed object $I_o$, to the earthed bell $I_g$ and to the directing air ring $I_l$.

$$I=I_o+I_l+I_g.$$

In the electrical sense, this is a multi-electrode arrangement with different potentials. In first approximation, however, it can be assumed that the parameters $c_o$, $c_g$, $c_l$, $U_{0o}$, $U_{0g}$ and $U_{0l}$ are dependent on the geometry alone and not on potentials. Consequently, in first approximation, the atomizer is described by the five equations presented.

Experimental investigations have shown that a very good performance of the atomizer (high application efficiency and little soiling) is obtained if the current to the bell 6 is about 400 uA, the current to the object is about 100 uA and the current from the object to the bell is about 100 uA. This mutual adjustment depends not only on the resistance but also on the position of the needle electrodes. Resistances in the range from 10 MΩ to 500 MΩ generally prove to be suitable.

We claim:

1. A high-speed rotary atomizer for applying electrically conductive paint, including water based paints, the high-speed rotary atomizer comprising:

an electrode configuration having electrodes for electrostatic external charging;

an atomizer housing formed of an electrically insulating material;

driving devices disposed in said atomizer housing;

an electrically conductive spraying bell to be connected to an earth potential, said spraying bell able to be set in rotation by said driving devices;

a directing air ring formed of an electrically conductive material which operationally carries a high-voltage potential and said directing air ring is capable of blowing out directing air; and a device forming an ohmic resistance in a range from 10 MΩ to 500 MΩ and establishing an electrical connection of said directing air ring to the earth potential through said ohmic resistance.

2. The high-speed rotary atomizer according to claim 1, wherein said device includes at least one resistance component disposed for connecting said directing air ring to the earth potential.

3. The high-speed rotary atomizer according to claim 2, including at least one spring element disposed between said resistance component and said directing air ring for providing an electrical contacting of said resistance component.

4. The high-speed rotary atomizer according to claim 1, wherein said directing air ring is formed from a high-impedance material, so that said directing air ring itself is used as said device for connecting to the earth potential, said directing air ring having an ohmic resistance in a range from 10 MΩ to 500 MΩ between an edge of said directing air ring facing said electrodes and a component carrying the earth potential.

5. The high-speed rotary atomizer according to claim 1, including an electrically insulating part covering said directing air ring in a region facing said spraying bell, whereby a minimum distance of 4 mm to 15 mm is set between an uncovered region of said directing air ring and said spraying bell.

6. The high-speed rotary atomizer according to claim 1, including an electrically insulating part covering said spraying bell on its outer side, facing said directing air ring.

7. The high-speed rotary atomizer according to claim 1, including:

an insulating-material cover covering at least a part of said directing air ring facing said electrodes; and a ring formed of a high-impedance material is inserted between said insulating-material ring and said directing air ring to reduce a field strength, air gaps between said ring, said insulating-material ring and said directing air ring being avoided by suitable shaping of said ring, said insulating-material ring and said directing air ring.

8. The high-speed rotary atomizer according to claim 1, including an insulating part covering a partial region of a surface of said directing air ring, said insulating part covering an edge of said directing air ring facing said spraying bell to reduce a risk of electrical breakdowns between said directing air ring and said spraying bell.

9. The high-speed rotary atomizer according to claim 8, wherein said insulating part has openings formed therein such that additional air can be blown through said openings in said insulating part into an intermediate space between said insulating part and said spraying bell, whereby air vortices at an edge of said spraying bell can be avoided.

10. The high-speed rotary atomizer according to claim 7, including a coating of a high-impedance material on a front edge of said insulating-material cover to reduce a field strength in a region of said front edge of said insulating-material cover.

11. The high-speed rotary atomizer according to claim 10, wherein said coating is a paint coating.

* * * * *